US008201699B2

(12) United States Patent
Zummo et al.

(10) Patent No.: US 8,201,699 B2
(45) Date of Patent: Jun. 19, 2012

(54) INTERCONNECTING BOTTLES UTILIZED TO CREATE STRUCTURES

(76) Inventors: Peter Zummo, Pittsboro, NC (US); Matthew John Naples, Shrewsbury, MA (US)

( * ) Notice: Subject to any disclaimer, the term of this patent is extended or adjusted under 35 U.S.C. 154(b) by 477 days.

(21) Appl. No.: 12/421,663

(22) Filed: Apr. 10, 2009

(65) Prior Publication Data

US 2009/0255893 A1 Oct. 15, 2009

Related U.S. Application Data

(60) Provisional application No. 61/043,922, filed on Apr. 10, 2008.

(51) Int. Cl.
*B65D 21/028* (2006.01)
*B65D 21/032* (2006.01)

(52) U.S. Cl. ..... 215/10; 206/504; 206/511; 220/23.4; 220/23.6; 428/33

(58) Field of Classification Search ..... 215/10; 220/23.4, 23.6, 23.83; 446/77, 117, 121; 206/504, 511; 428/33
See application file for complete search history.

(56) References Cited

U.S. PATENT DOCUMENTS

| | | | | |
|---|---|---|---|---|
| D69,462 | S | 2/1926 | Sears | D9/550 |
| D70,765 | S | 8/1926 | Jones | D9/556 |
| D92,781 | S | 7/1934 | Tricard | D9/550 |
| D101,483 | S | 10/1936 | Mott | D9/537 |
| 2,641,374 | A | 6/1953 | Yuen | |
| 3,369,658 | A | 2/1968 | Hasselmann | |
| 3,374,917 | A * | 3/1968 | Troy | 220/23.4 |
| 3,391,824 | A | 7/1968 | Wiseman | |
| 3,474,843 | A | 10/1969 | Maris | |
| 3,889,834 | A | 6/1975 | Harris | |
| 3,976,228 | A | 8/1976 | Robbins | |
| 3,994,408 | A | 11/1976 | Belitzky | |
| 4,127,207 | A | 11/1978 | Hubert | |
| 4,308,955 | A | 1/1982 | Schieser | |
| 4,381,841 | A * | 5/1983 | Schwarz | 220/23.4 |
| D281,862 | S | 12/1985 | Bertrand | D9/545 |
| 4,592,478 | A * | 6/1986 | Laconis | 220/23.83 |
| 4,624,383 | A | 11/1986 | Moore | |
| 4,685,565 | A | 8/1987 | Sparling | |
| D305,984 | S | 2/1990 | Alberghini et al. | D9/500 |
| 5,002,199 | A | 3/1991 | Frahm | |
| 5,054,617 | A * | 10/1991 | Young et al. | 206/509 |
| 5,480,028 | A | 1/1996 | Robinson | |
| 5,669,519 | A * | 9/1997 | Notz et al. | 215/10 |
| D404,651 | S | 1/1999 | Warner et al. | D9/552 |
| D407,020 | S | 3/1999 | Doty | |
| 5,890,595 | A * | 4/1999 | Credle, Jr. | 206/501 |
| D424,948 | S | 5/2000 | Ullmo | D9/540 |
| 6,146,232 | A | 11/2000 | Robbins | |
| 6,186,856 | B1 * | 2/2001 | Chen | 446/128 |

(Continued)

*Primary Examiner* — Sue Weaver
(74) *Attorney, Agent, or Firm* — Andrew F. Young, Esq.; Lackenbach Siegel, LLP

(57) ABSTRACT

The present invention consists of a water or soda bottle or vessel which is designed to allow for the bottle to interconnect with other bottles of similar design and standard dimensions to form useful second use products. A recess in the lower surface of the bottle receives the neck of another storage bottle. There are recesses perpendicular to the vertical axis of the bottle capable of receiving the mating side recess of another storage bottle. There are two such recesses on each storage bottle, one on each side of the bottle, parallel to each other. This allows for a bottle positioned on its side perpendicular to a vertically positioned bottle to be used to connect two vertically perpendicular storage bottles.

19 Claims, 14 Drawing Sheets

Section D-D

U.S. PATENT DOCUMENTS

| | | | | |
|---|---|---|---|---|
| 6,276,549 | B1 * | 8/2001 | Fasci et al. | 220/23.4 |
| D496,280 | S | 9/2004 | Mero et al. | D9/538 |
| 6,932,228 | B1 | 8/2005 | Darr | |
| D509,436 | S | 9/2005 | Mero et al. | D9/538 |
| D509,746 | S | 9/2005 | Mero et al. | D9/538 |
| D510,271 | S | 10/2005 | Mero et al. | D9/538 |
| D515,933 | S | 2/2006 | Mero et al. | D9/538 |
| 7,644,828 | B1 * | 1/2010 | Klein | 215/10 |
| 2001/0030191 | A1 * | 10/2001 | Bopp et al. | 220/23.4 |
| 2004/0116037 | A1 * | 6/2004 | Garpow | 446/74 |
| 2005/0011853 | A1 * | 1/2005 | Brugger | 215/10 |
| 2009/0090647 | A1 * | 4/2009 | Panchal et al. | 206/504 |

* cited by examiner

Section A–A

Section B–B

FIG. 9
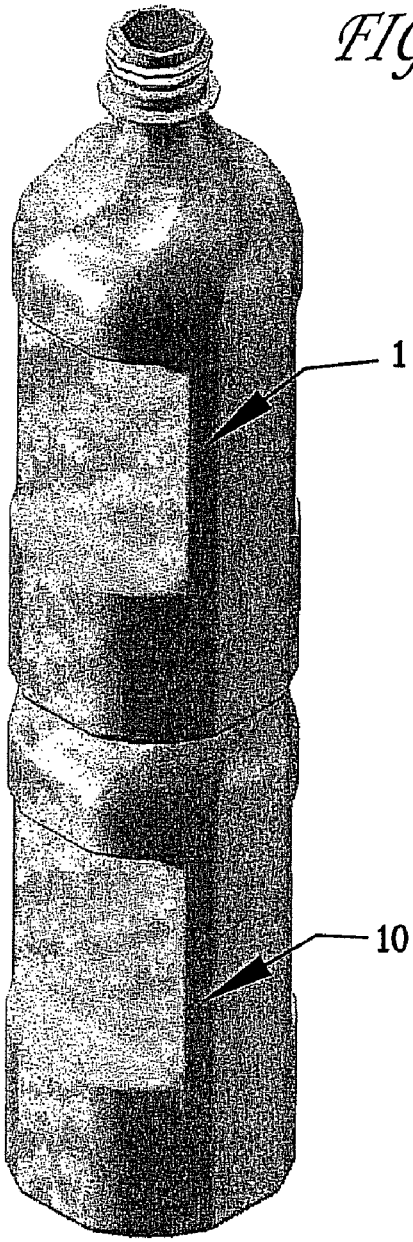
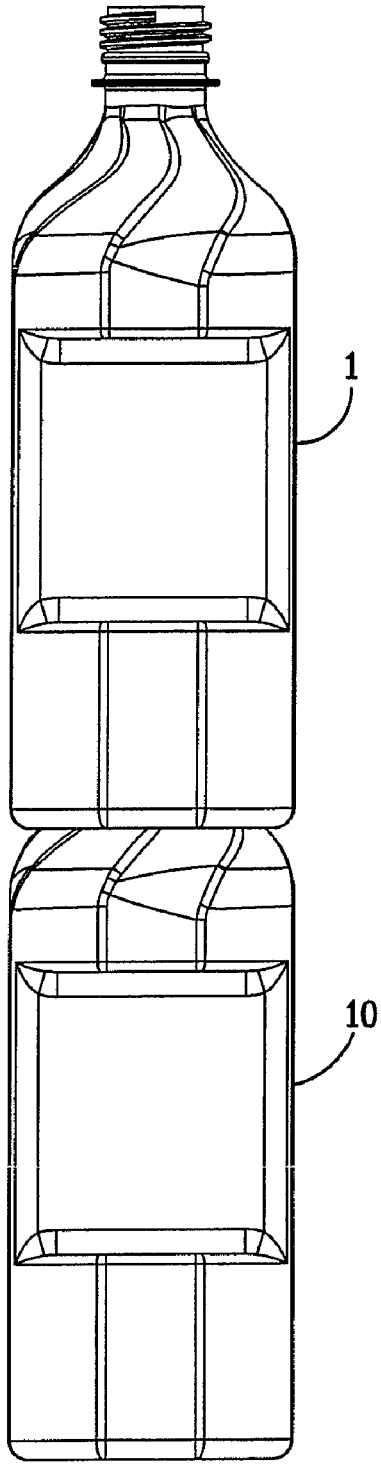
FIG. 10

Section C–C

Section D-D

INTERCONNECTING BOTTLES UTILIZED TO CREATE STRUCTURES

CROSS REFERENCE TO RELATED APPLICATIONS

Applicant is the owner of U.S. Provisional application 61/043,922, filed 10 Apr. 2008, and hereby claims priority pursuant to 35 U.S.C. 120 and 37 C.F.R. 1.78.

FIELD OF THE INVENTION

The Invention relates to the bottling industry and, more particularly, to bottles that may be interconnected to form various structures.

BACKGROUND OF INVENTION

The present invention consists of a water or soda or beverage bottle or vessel which is designed to allow for the bottle to interconnect with other bottles of similar design and standard dimensions to form useful second use products. Current container designs allow for users to use the contents within and then discard the container. This process results in a large number of bottles being disposed into landfills, which is a waste of usable material.

DESCRIPTION OF RELATED ART

It is known to provide stackable bottles which permit stacking on top of one another or when laid on their sides. These nesting, stackable bottles often do not provide any means of interconnection to provide stability to the stack of bottles, so that it might be used as a stable constructed item. It is also known to provide bottles with tongue and groove recesses on their sides. These recesses and protrusions permit the connection of two or more bottles positioned parallel to each other, often as a means to reduce the need for secondary packaging during shipping. These recesses and protrusions often disrupt the natural shape of the bottle, causing discomfort when used for its primary use, as a beverage vessel.

Yuen (U.S. Pat. No. 2,641,374) describes a cubic bottle with a protruding neck out of the top and corresponding recess in the bottom of the bottle. Radiating from the neck of the bottle are ribs which again have corresponding recesses on the bottom. These recesses serve the purpose as an indexing agent to ensure the planar alignment of two bottles stacked one on top of the other. It does not mention any securing feature to temporarily lock the bottles together once stacked one above the other. There is no horizontal connection of the bottles. There is no disclosure of interconnecting the bottles to provide stable secondary products.

Hasselmann (U.S. Pat. No. 3,369,658) is used to aid in the shipment of liquids and other goods which can be contained in large bottles. There are protrusions and recesses on all four sides. Once the bottles are arranged in the desired size cubic shape, bands are utilized to firmly connect all the bottles together. It does not describe a standalone sturdy secondary structure.

Wiseman (U.S. Pat. No. 3,391,824) discloses vertical stacking containers, but there is no horizontal connection between the containers. It is designed for ease of storage and display on store shelves. There is no means of perpendicular connection and does not allow for connection of bottles next to each other if an overhanging bottle exists. There is no disclosure of interconnecting the bottles to provide stable secondary products.

Maris (U.S. Pat. No. 3,474,843) is a large industrial use bottle for the transportation and storage of large quantities of materials, such as pellets or liquids. The container is designed with feet protruding out of the bottom of the container with spacing sufficient enough to allow the engagement of a fork-lift with the container. Corresponding to these feet on the top of the container are the recesses to allow for indexing and stable stacking of one container on top of another. There is no disclosure of any horizontal connection between the containers.

Harris (U.S. Pat. No. 3,889,834) discloses a liquid storage bottle, such as a water cooler bottle, which is designed to eliminate the need for an additional rack when stacking or transporting the bottles. The bottle design consists of two wave extrusions which interact with extrusions on the opposite side of another bottle design. This connection method as shown is unidirectional, in other words the top side of a bottle will only interact with the bottom side of another bottle or vice versa. It does not work unless the bottles are oriented correctly.

Robbins (U.S. Pat. No. 3,976,228) is a liquid storage system. Each container has walls of thin plastic material with the top and one sidewall of each container including a plurality of protuberances and the bottom and other sidewall including a plurality of indentations complementary to the protuberances so that, when like storage containers are brought into adjacent relationship, protuberances in one wall of one container are received in and mate with the indentations in one wall of the other container to facilitate maintaining vertical stacking and/or abutting side-by-side relationship of the system. The purpose of these connections is to allow for the expansion of a small container to a large container, not for the production of sturdy standalone secondary structures.

Belitzky (U.S. Pat. No. 3,994,408) describes a complicated design for an interlocking container which includes: a central body portion, a first arm extending outwardly from one portion of the central body, and a second arm extending outwardly from a second portion of the central body. These are used for reusable ice pack substitutes. The goal in this patent is to allow for the expansion of reusable ice packs to varying sizes as needed and ease of storage within a freezer or fridge. While a liquid container, the invention is not designed as a beverage vessel and therefore does not take into consideration drinking ergonomics or holding comfort in the design of its shape. There is no disclosure of interconnecting the bottles to provide stable secondary products.

Hubert (U.S. Pat. No. 4,127,207) discloses a stackable plastic bottle having a bulging base and a base wall and a neck wall provided with an orifice in which the base wall and the neck wall each possess a central zone which, by virtue of a shoulder, projects relative to the peripheral zones of these walls. There is no horizontal connection of the containers. This bottle functions similarly to a propane cylinder to permit stacking. It allows for stacking of bottles with sensitive necks, but does not provide a firm connection to allow for safe stacking of a multitude of bottles. There is no disclosure of interconnecting the bottles to provide stable secondary products.

Schieser (U.S. Pat. No. 4,308,955) is a large light-weight bottle made of plastic of the type used on water dispensers. Each bottle is made of rectangular or square transverse cross-section with spaced reinforcing ribs or bands extending therearound. On opposed flat faces or sides, each bottle is provided, respectively, with a square locking projection and a complemental receiving socket so that a plurality of the bottles can be stacked on their sides with the locking projections and sockets of adjacent sides interfitting to keep the bottles in alignment in the stack and with the reinforcing ribs superimposed for strength. These bottles do not stack vertically and thus are limited in their ability to provide stable secondary products. Moreover, as disclosed, "the bottle . . . is made of thin plastic material . . . [and] will, consequently, be of very light weight having thin walls." In order "to give the side walls adequate strength, embossed reinforcing ribs or bands 26 are formed on the walls" Therefore, this bottle is especially unsuited for forming any sturdy stable secondary products.

Moore (U.S. Pat. No. 4,624,383) describes an interlocking environmental container that allows milk, juice and various food containers to be saved for use as building blocks for such items as children's toys, lawn furniture or sheds. Tongue and groove construction of one pair of opposing sides combined with top and bottom mounting means and special corner pieces allows the containers to be built into semi-rigid structures. It allows solely for tongue and groove side connections. Using just tongue and groove side to side connections poses some problems when producing cantilever or beams which span a gap, such as the upper member of a doorframe. A tongue and groove system relies solely on friction of the tongue and groove to keep the bottles secure vertically. When a load is placed on the bottles used to make the beam, the overhanging bottles will be unable to bear the load and will slide apart. It does not provide a sturdy reliable secondary structure. Furthermore, while it does allow for vertical connections by inserting the neck of the bottle into the bottom of another bottle, there is no designated recess for the neck. A perforation or cutout is positioned on the bottom large enough for the neck of the bottle to be inserted into without a cap. Once inserted, a side perforation or cutout is then broken to allow for a user to insert the cap into the bottle to thread onto the neck and tighten the two bottles together. This does not allow the bottles to be connected until after the consumer has emptied the bottle and, when the bottles are connected, the side cutout renders refill of the bottle impossible. Since the bottle cannot be sealed when connected due to the side and bottom cutout, the bottles do not gain the increased strength of having a pressurized bottle to bear the weight of the structure. These perforated cutout areas also weaken the overall strength of the bottle itself, making the bottle unable to maintain pressures as high as if the perforated sections were not present.

Sparling (U.S. Pat. No. 4,685,565) illustrates and describes a beverage bottle system which contains tongue and grooves which are cut into the sides of the bottle, thereby allowing bottles to be connected parallel to each other. The bottle described in the patent does not allow perpendicular connections, or vertical connections. Instead it allows bottles to be interconnected with one another to form a multi-pack cluster. There are no side recesses for holding the side of another bottle in a stable environment; and, there is no disclosure of interconnecting the bottles to provide stable secondary products.

Frahm (U.S. Pat. No. 5,002,199) describes a liquid containment vessel for use in the storage and transportation of liquid, such as those used in water coolers. This bottle is preferably of rectangular cross-section with parallel oppositely disposed mating sides which permits secure and space-saving stacking of the bottles. The main aspect of the patent is the description of a better designed rib arrangement to prevent cracking. By separating the vertical and horizontal ribs, eliminating intersections, the high stress concentration areas of the intersections are eliminated and cracks are hindered.

Robinson (U.S. Pat. No. 5,480,028) illustrates and described a container system which allows for the vertical stacking of multiple plastic containers for storage and transport. The patent offers no parallel or perpendicular connections, nor does it offer any means, other than placing vertical stacks of containers next two each other, for use as a construction material. As can be seen in the drawings of this patent, the container described is a rectangular container, not very bottle like and not designed to be held comfortably in a hand. There are no side recesses for holding the side of another bottle in a stable environment; and, there is no disclosure of interconnecting the bottles to provide stable secondary products.

Darr (U.S. Pat. No. 6,932,228) describes stackable plastic containers including side portions having at least one of generally centrally located protrusions and depressions which nest with at least one of generally centrally located matching protrusions and depressions of a second container, and with the base portion including a generally centrally located depression which nests with a generally centrally located pouring spout of a second container. Due to the multiple protrusions and depressions on the side surface, it is not of the type used for standard beverage bottles. It provides too complicated a construction for such use.

Doty (U.S. Design Pat. D407020) describes a connectible storage container. This container allows for both parallel and vertical connections, allowing the containers to stack in the most space efficient means possible. The design does not, however, appear to fit easily within a consumer's hand. The design is square, with extruded "tongues" used to connect bottles together. It is not made to combine an ergonomic grip and a multitude of connections to allow for use as a structural element. There are no side recesses for holding the side of another bottle in a stable environment; and, there is no disclosure of interconnecting the bottles to provide stable secondary products.

Ideally, a connectable bottle for use in a connectable bottle system should incorporate a means of vertical, parallel, and perpendicular connections. This could consist of recesses in the bottoms of the bottles to allow for reception of the neck of the bottle. It could also consist of a recess within the side of the bottle which would receive the side of another bottle perpendicularly. These connections should be done in a way which would be semi-permanent, allowing for stability of the stacked structure with the ability to disassemble.

None of the bottles currently on the market incorporate all of the desired characteristics of an interconnecting bottle and interconnecting bottle system according to the present invention which can be utilized to form supporting structures such as, enclosures of all types, furniture and housing, among other things, from standard beverage bottles.

SUMMARY OF THE INVENTION

Therefore, it is an object of the invention to create a unique bottle construction to permit adjacent bottles to be connected to form stabile secondary products and structures.

In one of its aspects, the invention consists of a stackable storage bottle and a system of interlocking stackable storage bottles.

Another object of the herein invention is to re-utilize a container, currently being discarded, allowing for a new and novel use. The invention makes it simple and easy for anyone to turn this waste into items for use around the home, emergency shelters, or simple shelters for developing nations. By re-utilizing the container, it is proposed that its waste will no longer enter the world's landfills and will be put to use as an easy to use building material These and other objects of the Invention are achieved by utilizing a recess in the lower surface of the bottle that is sufficient to receive the neck of another storage bottle. The recess should allow for a form of locking to prevent the bottle from falling out without applying a force. Any storage bottle may be stacked vertically above or below another storage bottle.

The invention also consists of a recess perpendicular to the vertical axis of the bottle capable of receiving the mating side recess of another storage bottle. There are two such recesses on each storage bottle, one on each side of the bottle, parallel to each other. This allows for a bottle positioned on its side perpendicular to a vertically positioned bottle to be used to connect two vertically perpendicular storage bottles. As with the bottom recess, the side recesses should allow for a form of locking to prevent the perpendicularly positioned bottle from moving without applying a force.

Another aspect of the invention is that the bottle may be produced through blow-molding and may be a liquid storage bottle.

Yet another aspect of the invention is that the sizes of the storage bottles may be selected to conform to industry standard bottled beverage dispensers, or as a personal drinking water bottle, or new, non-standard sizes may be created.

Other aspects of the described invention will be appreciated by reference to the description of the preferred embodiment discussed below as well as the given figures and drawings included.

BRIEF DESCRIPTION OF THE DRAWINGS

FIG. 9 is a perspective view of two interconnecting bottles connected vertically in one orientation, according to the present invention;

FIG. 10 is a front view of two interconnecting bottles connected vertically in one orientation, according to the present invention;

DETAILED DESCRIPTION OF THE INVENTION

Figure 1:
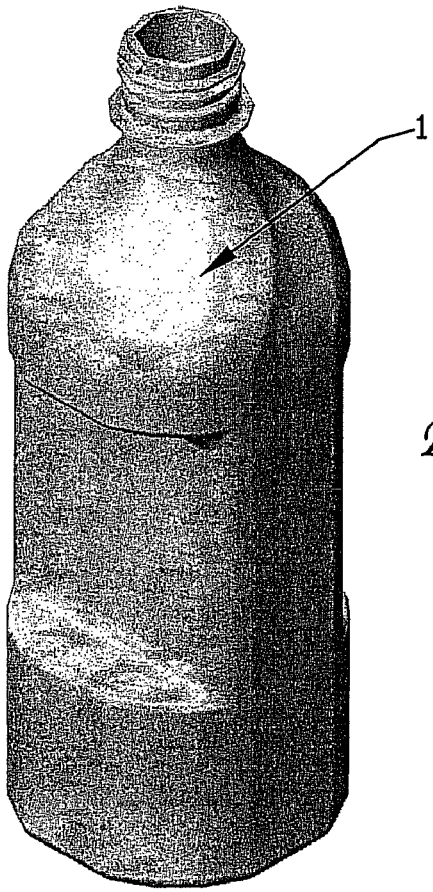
FIG. 1 is a perspective view of an interconnecting bottle, according to the present invention.
Figure 2:
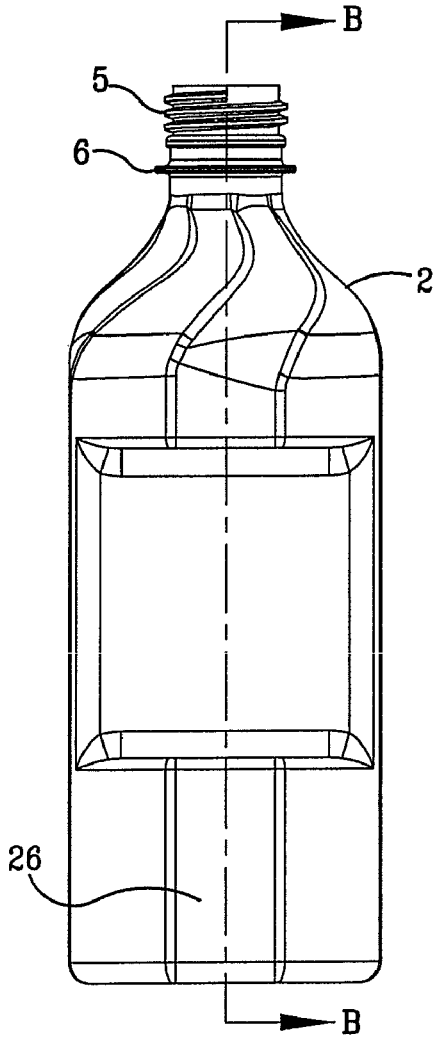
FIG. 2 is a front view of an interconnecting bottle, according to the present invention.
Figure 3:
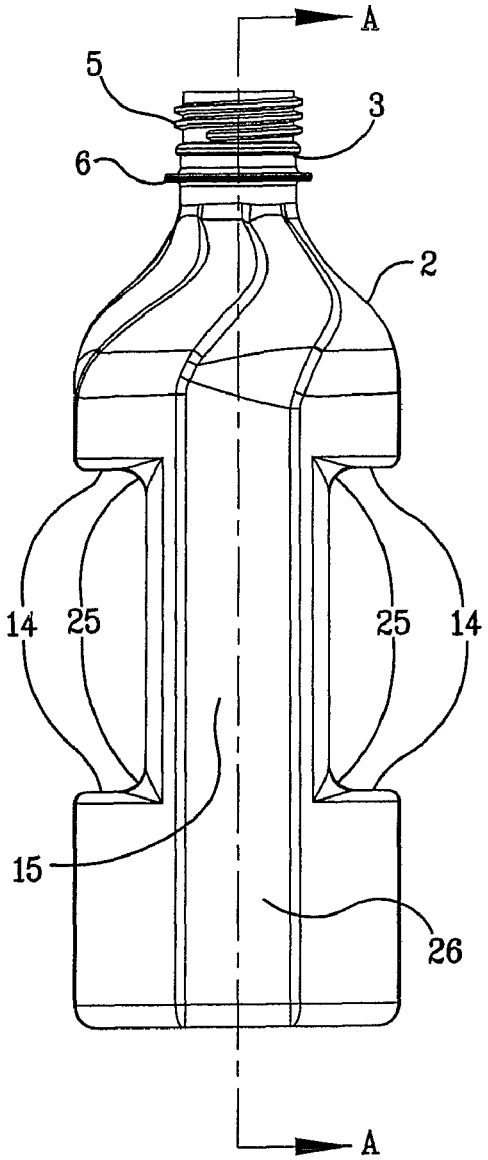
FIG. 3 is a right side view of an interconnecting bottle, according to the present invention.
Figure 4:
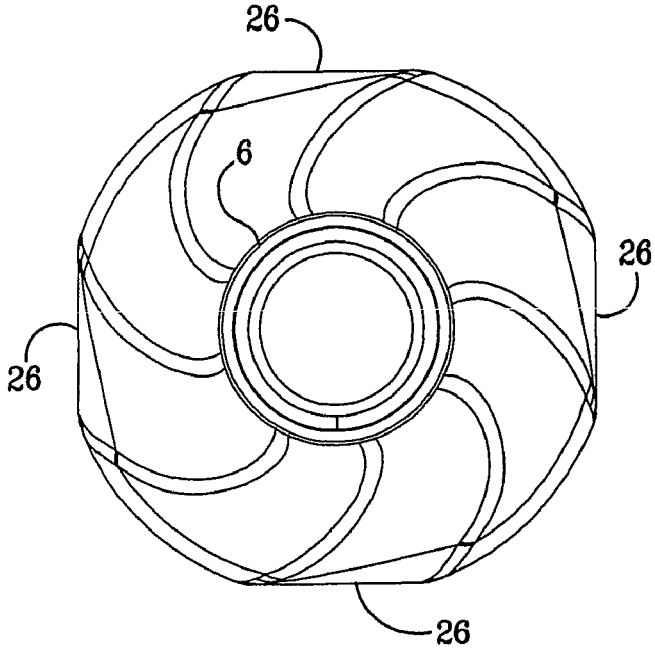
FIG. 4 is a top view of an interconnecting bottle, according to the present invention.
Figure 5A:
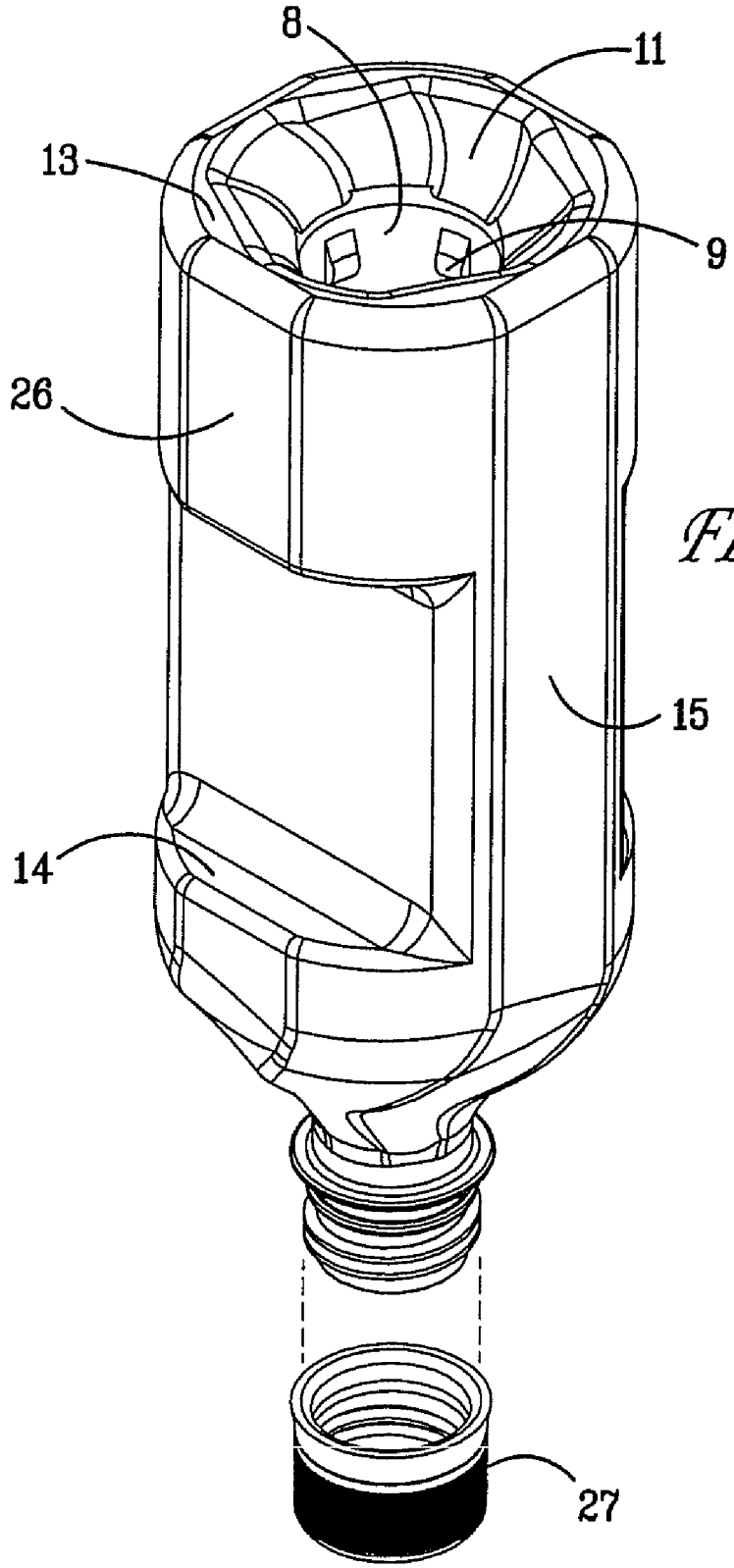
FIG. 5A is an isometric view of the bottom of an interconnecting bottle, according to the present invention.
Figure 5:
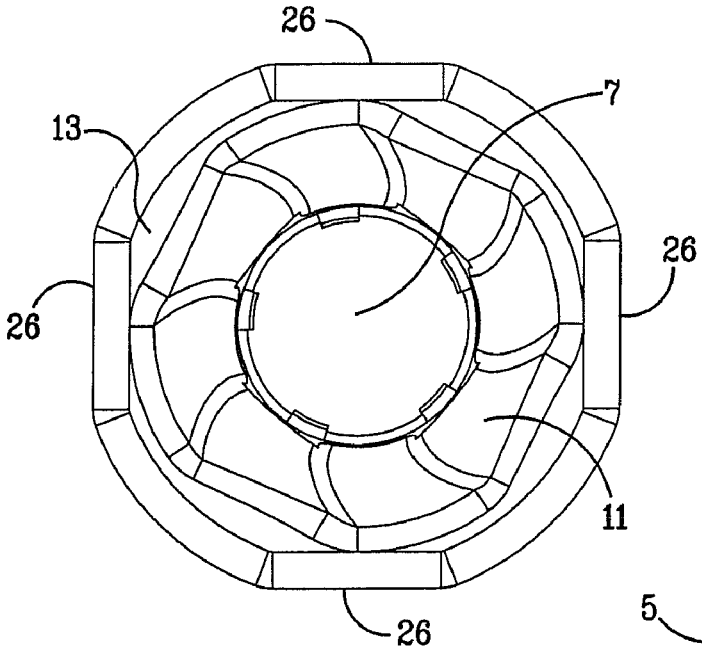
FIG. 5 is a bottom view of an interconnecting bottle, according to the present invention.
Figure 6:
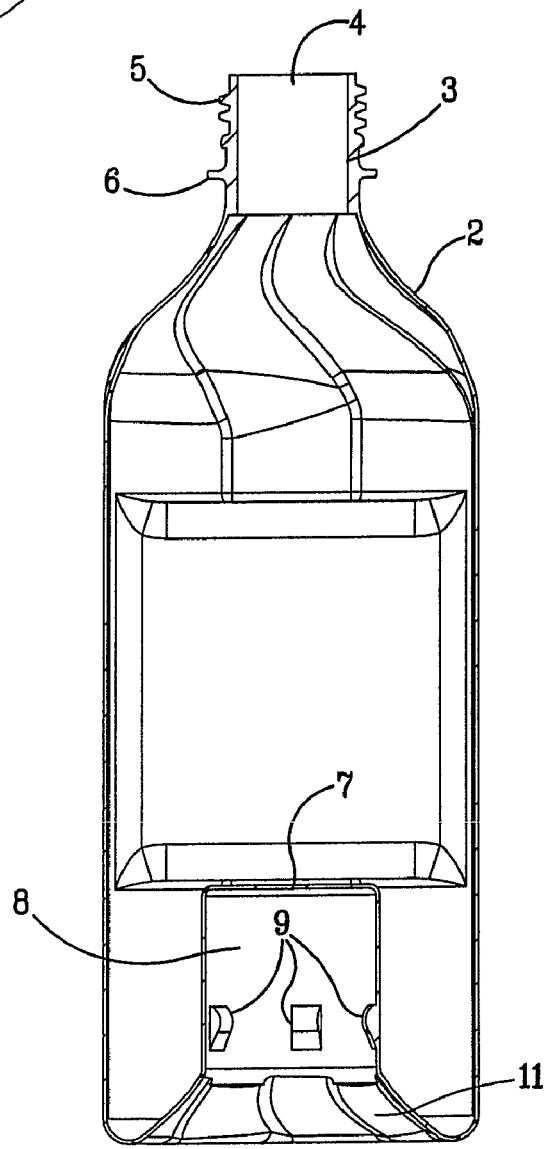
FIG. 6 is a cross section of an interconnecting bottle along A-A of FIG. 3, according to the present invention.
Figure 7:
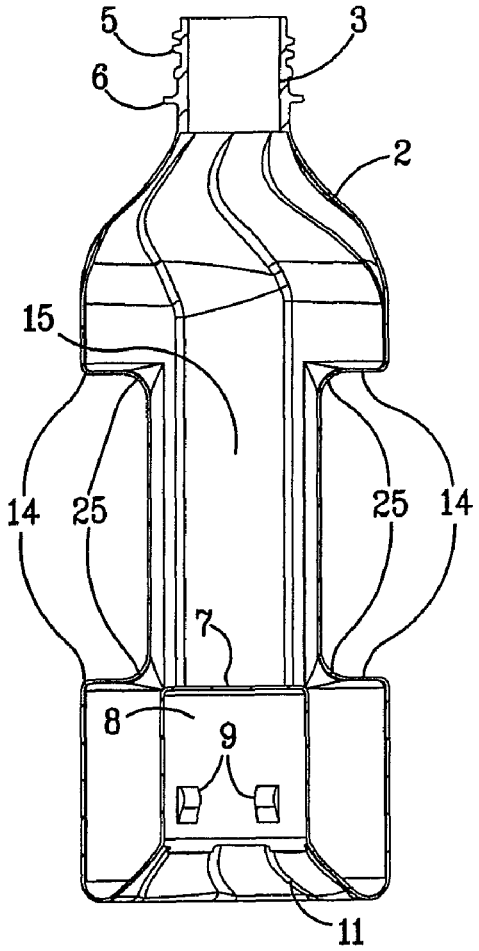
FIG. 7 is a cross section of an interconnecting bottle along B-B of FIG. 2, according to the present invention.
Figure 8:
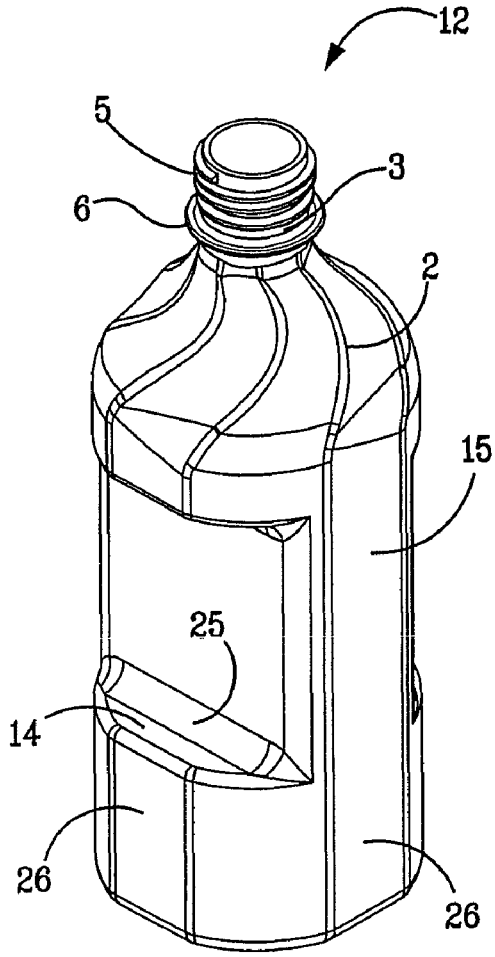
FIG. 8 is an isometric view of an interconnecting bottle, according to the present invention.
Figure 11:
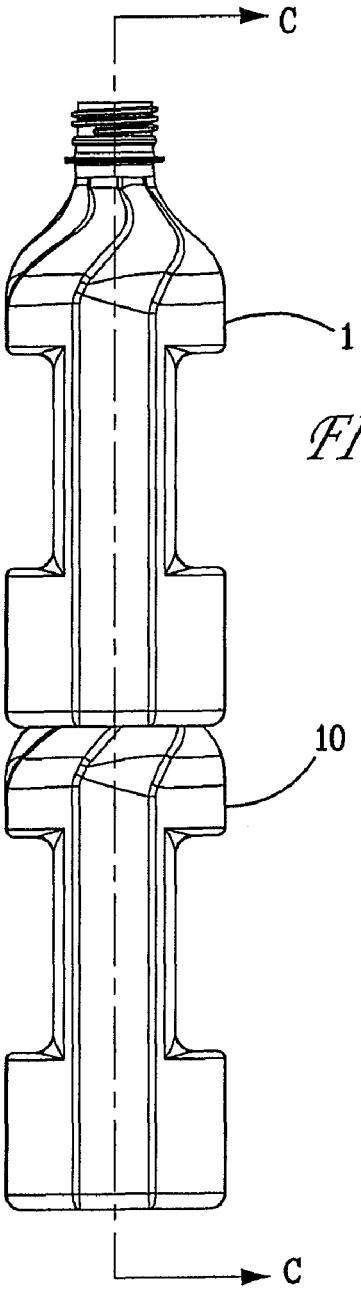
FIG. 11 is a side view of two interconnecting bottles connected vertically in one orientation, according to the present invention.

Referring first to FIGS. 1 thru 8, a constructible bottle 1 according to the present invention forms a storage compartment. As is typical for such bottles, it is integrally made with side walls joined at the bottom with an open mouth at the top. Generally, it is cylindrical, but any geometrical shape is acceptable. Ideally, the constructible bottle 1 is for the storage and transport of personal drinks for user consumption. Such drinks may include water, soft drinks, juices, and other assorted beverages. The constructible bottle 1 may be incorporated into any liquid carrying or dispensing system such as bottle water systems for coolers and bottle dispensing vending machines. Additionally, the constructible bottle 1 may be used for any purpose which is conducive to the transportation of items in a bottle, such as liquids, powders, gases, granulars, and other such materials.

According to the herein Invention, the constructible bottle 1 has a lofted top 2, having a centrally disposed protruding neck 3 extending from the curved upper surface with an opening 4 therein. The protruding neck 3 contains threads 5 for the receiving of an internally threaded cap 27 and a protruding lip 6 below the end of the threads 5. The addition of a threaded cap 27 will form a container for carrying liquids. It may be appreciated that any cap may be utilized and a threaded cap 27 is mentioned as just one possibility. A snap fit cap, or any other cap, may also be used.

Figure 12:
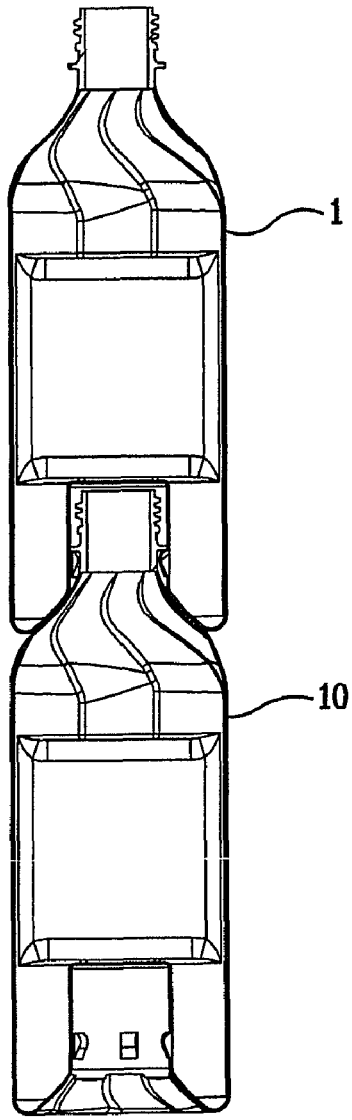
FIG. 12 is a cross section of two interconnecting bottles connected vertically in one orientation along C-C of FIG. 11, according to the present invention.
Figure 13:
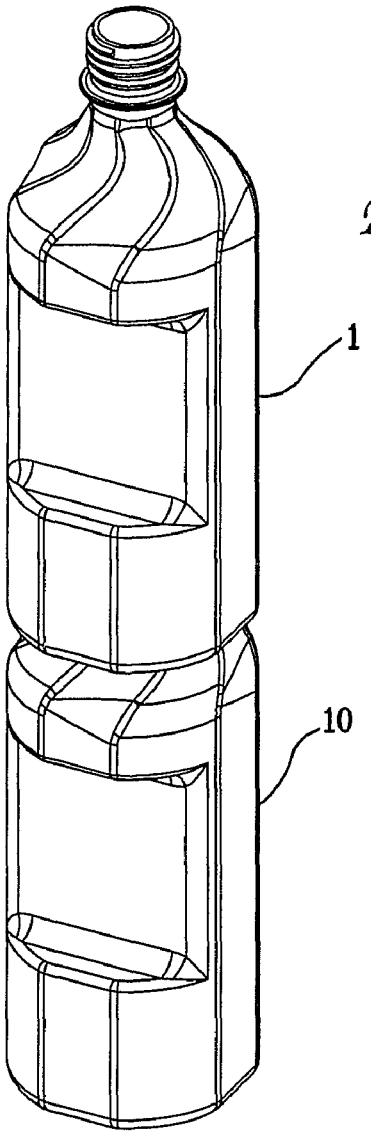
FIG. 13 is an isometric view of two interconnecting bottles connected vertically in one orientation, according to the present invention.
Figure 14:
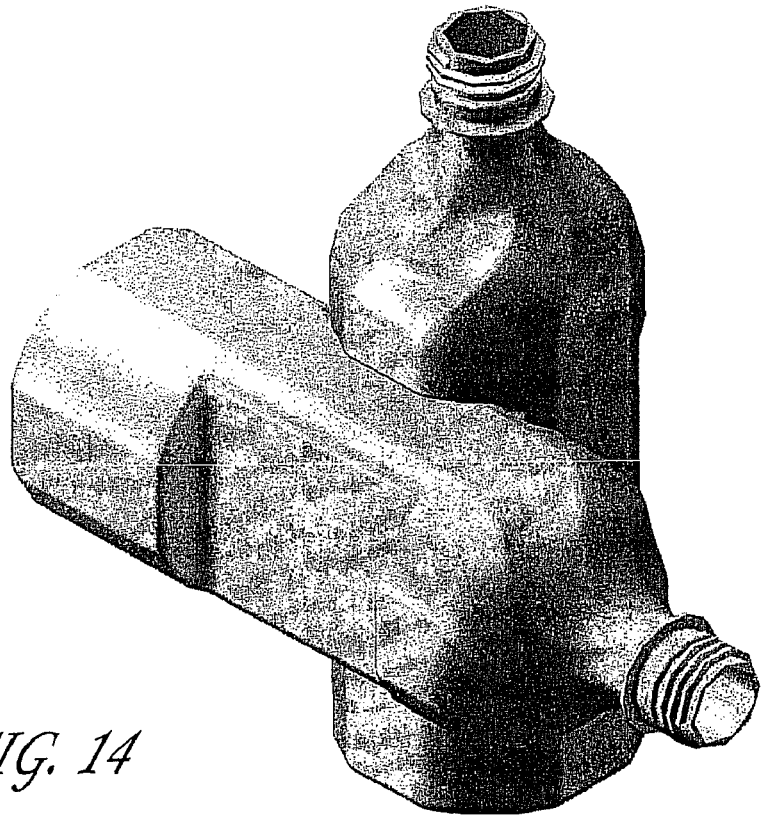
FIG. 14 is a perspective view of two interconnecting bottles connected perpendicularly, according to the present invention.
Figure 15:
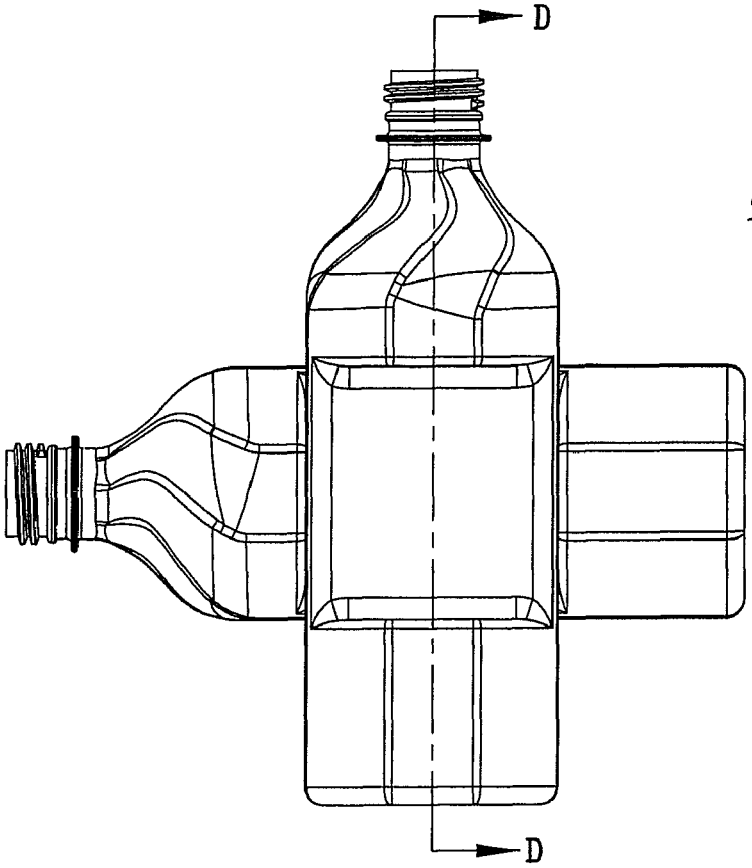
FIG. 15 is a front view of two interconnecting bottles connected perpendicularly, according to the present invention.
Figure 16:
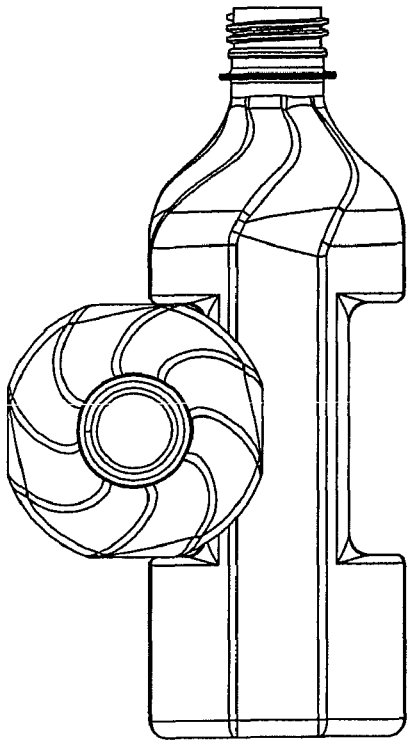
FIG. 16 is a side view of two interconnecting bottles connected perpendicularly, according to the present invention.
Figure 17:
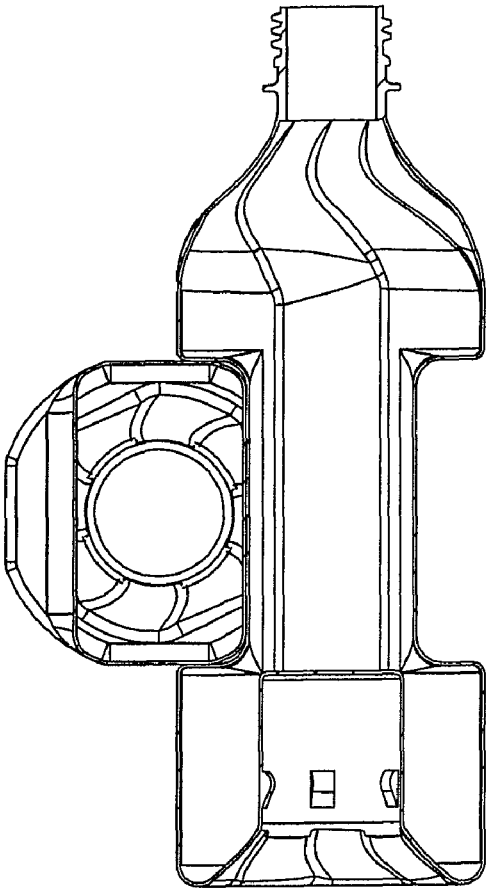
FIG. 17 is a cross section of two interconnecting bottles connected perpendicularly along D-D of FIG. 15, according to the present invention.
Figure 18:
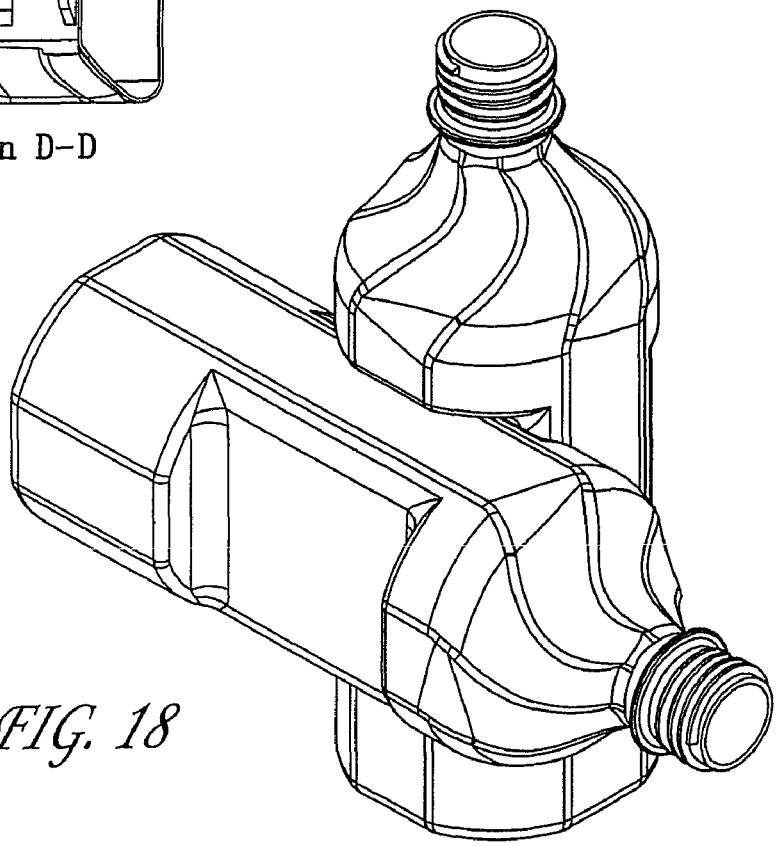
FIG. 18 is an isometric view of two interconnecting bottles connected perpendicularly, according to the present invention.
Figure 19:
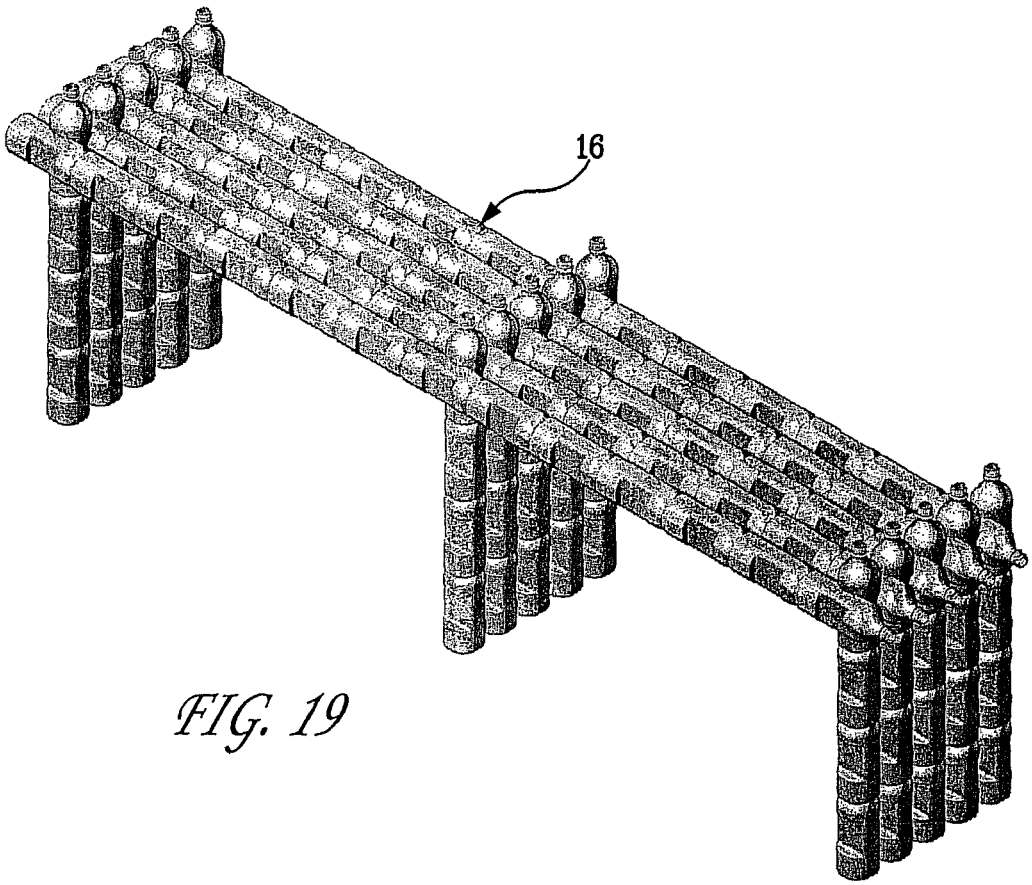
FIG. 19 is a perspective view of a bench as constructed using the interconnecting bottle, according to the present invention.
Figure 20:
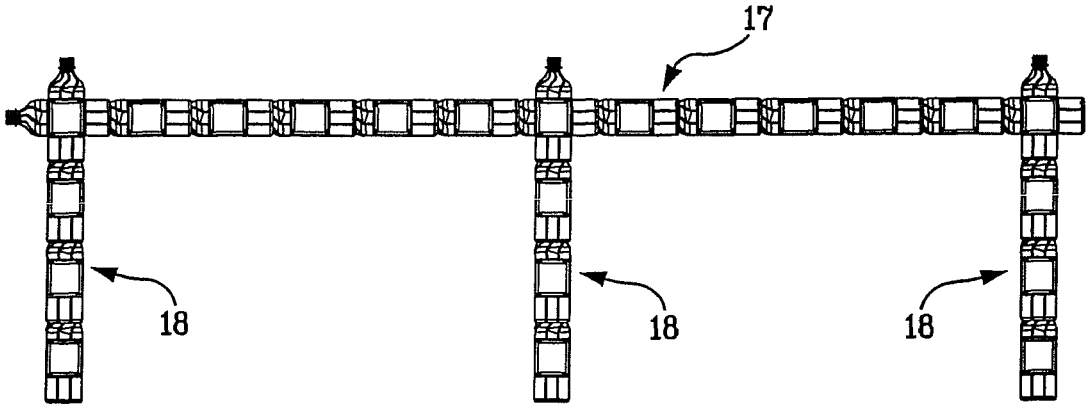
FIG. 20 is a front view of a bench as constructed using the interconnecting bottle, according to the present invention.
Figure 21:
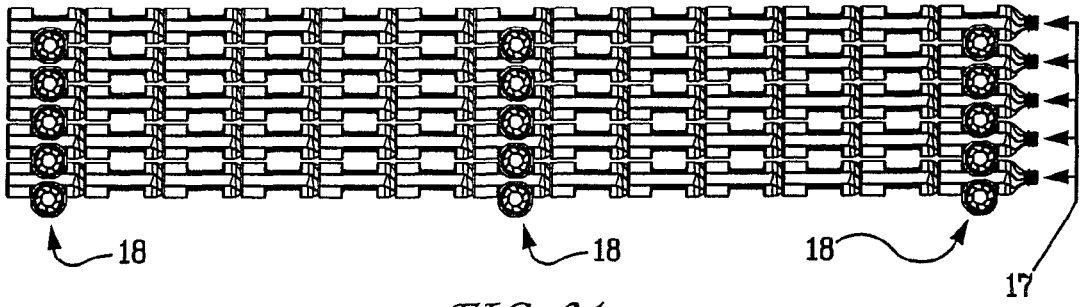
FIG. 21 is a top view of a bench constructed using the interconnecting bottle according to the present invention.
Figure 22:
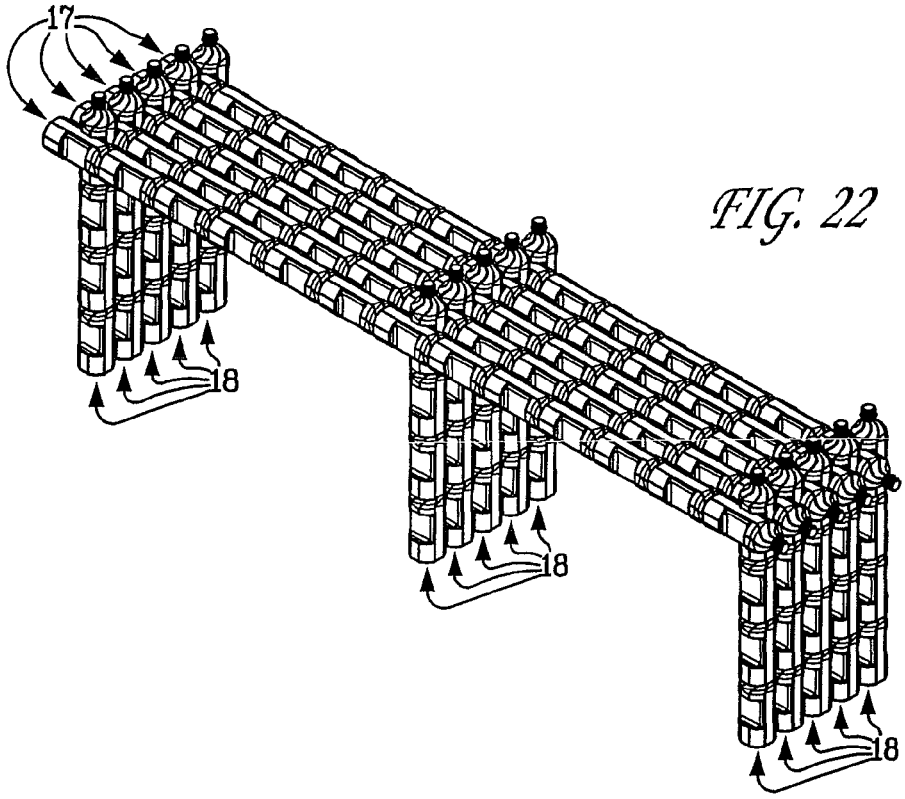
FIG. 22 is an isometric view of a bench constructed using the interconnecting bottle, according to the present invention.
Figure 23:
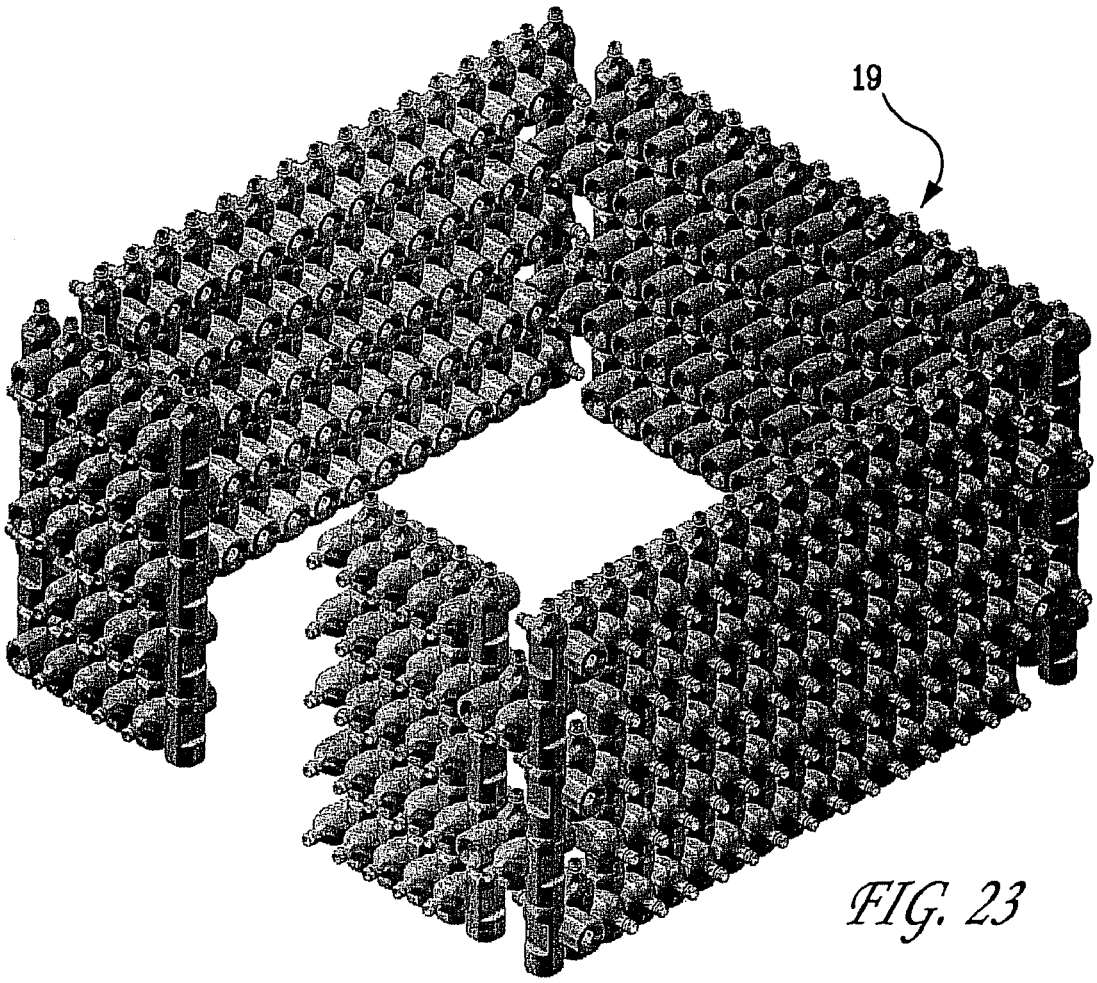
FIG. 23 is a perspective view of an enclosure as constructed using the interconnecting bottle, according to the present invention.
Figure 24:
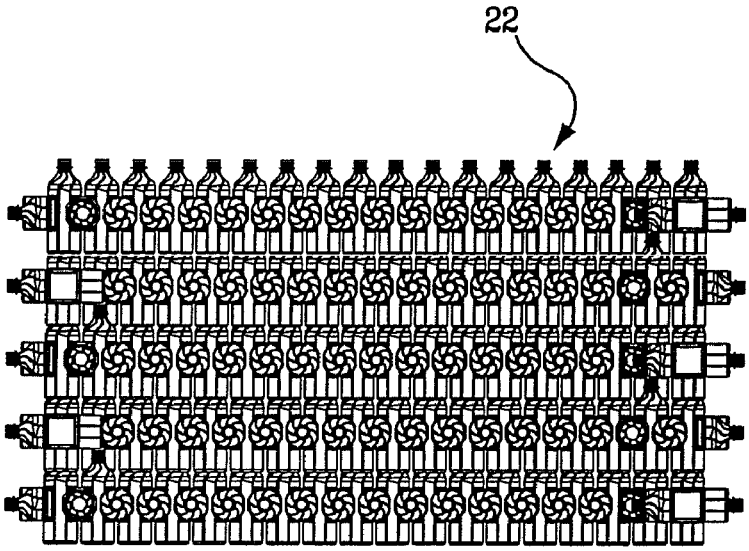
FIG. 24 is a right side view of an enclosure as constructed using the interconnecting bottle, according to the present invention.
Figure 25:
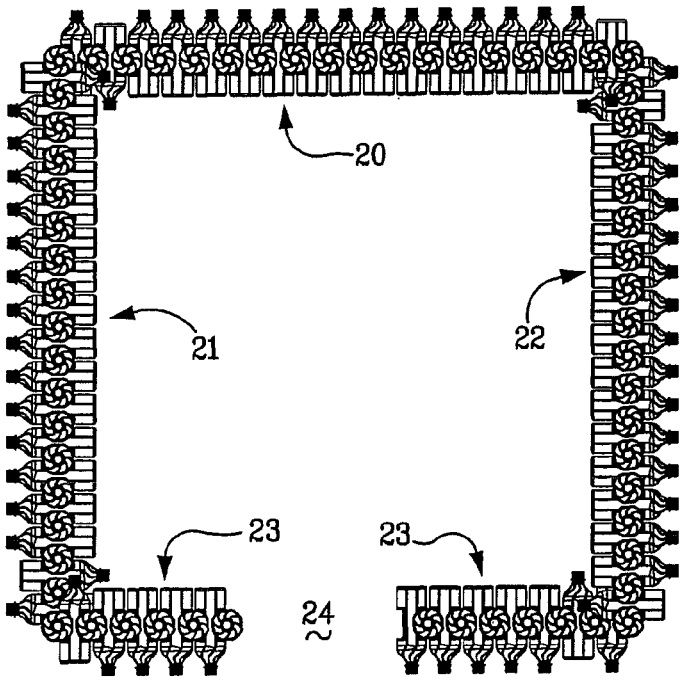
FIG. 25 is a top view of an enclosure as constructed using the interconnecting bottle, according to the present invention.
Figure 26:
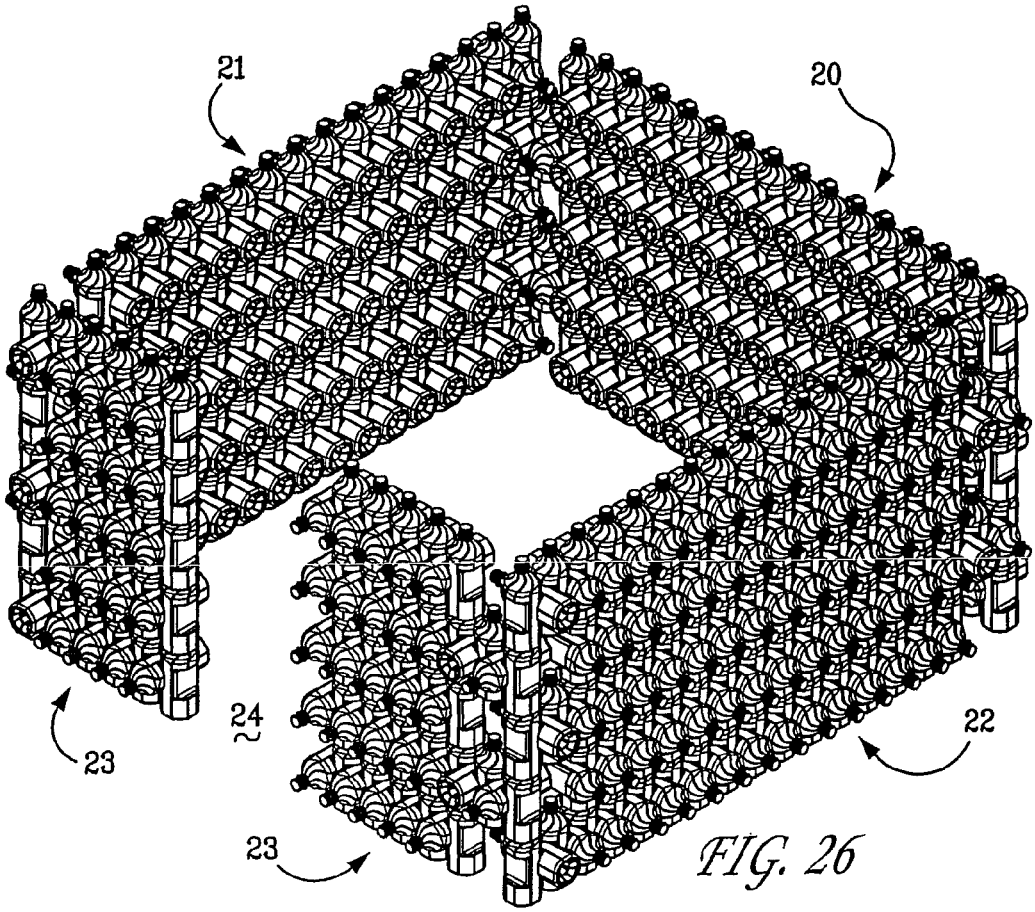
FIG. 26 is an isometric view of an enclosure as constructed using the interconnected bottle, according to the present invention.

The bottom 7 of the constructible bottle 1 contains a negative image 11 of the lofted top 2 and a shaft 8 of proper dimensions to receive the protruding lip 6 of the neck. Within this shaft 8 there are convex protrusions 9, or snaps, of slightly smaller dimensions than the external dimension of the protruding lip 6. Thus, when a bottle is connected vertically, FIG. 12, the convex protrusions act to prevent the easy removal of the neck 3 of the bottom of the constructible bottle 10 from shaft 8 and negative image 11 from the top of the constructible bottle 12.

Generally, in a preferred embodiment, the four sides 26 of the constructible bottle 1 as well as the bottom surface 13 of constructible bottle 1 are flat and perpendicular. Other shapes may be used without departing from the central theme of the invention.

The constructible bottle 1 has two side gaps 14 which are wide enough to receive the widest external dimension of a constructible bottle 1. These side gaps 14 may be a proper dimension to provide a press fit connection or may be designed with a lip and mating groove located on the side 15 of constructible bottle 1 to provide a snap connection. The side gap 14 depth is of proper depth to prevent interference with the side of another constructible bottle when three constructible bottles 1 are connected as seen in FIGS. 14 thru 18.

Preferably, the two side gaps 14 are generally flat to allow for no gap when two bottles are connected perpendicularly as seen in FIGS. 14 thru 18. The edges of the side gaps 14 contain radii 25 to decrease stress concentrations and increase the strength of the bottle. The radii in the side gaps are designed as to allow for the radii on two bottles to mate when interconnected see FIG. 17.

FIGS. 19 thru 22 demonstrate the system of the invention as a bench 16, where the constructible bottle 1 may be interconnected in a vertical, perpendicular, or a combination of vertical and perpendicular bottles and layers to form other useful articles. Here, thirteen constructible bottles 1 were connected vertically in a line to form seat segment 17. Four constructible bottles 1 were connected vertically to form leg segment 18. When five seat segments 17 and fifteen leg segments 18 are connected, they form a bench 16 four bottles high, thirteen bottles wide, and five bottle diameters deep.

FIGS. 23 thru 26 demonstrate the system of the invention as an enclosure 19, where the constructible bottle is connected vertically, perpendicularly, and a combination of both vertical and perpendicular bottles to form layers with which walls 20 thru 23 are made. The roof, not shown, could be constructed using constructible bottles 1 or could be another material positioned as a roof. The doorway 24 is constructed by simply leaving a gap of bottles into any of walls 20 thru 23. Windows, not shown, may be constructed using the same method of doorway 24.

It may be appreciated that the bench and enclosure are just two of a myriad number of structures that may be constructed with the herein bottles. The bench and the enclosure are just illustrative examples.

Being a vessel for the transport of materials such as liquids, granulars, powders, and other materials, the constructible bottle 1 can be filled with such materials for increased strength, insulation, opacity, or any other desired trait.

While the above bench and enclosure are described in detail, it can be appreciated that benches of different orientations and sizes and enclosures of different shapes may be constructed. Similarly, it can be appreciated that the usefulness of the invention is not limited to the described bench and the following list of chairs, lounges, tables, shelves, cabinets, enclosures, and other items which may be made. The constructible bottle of this invention may be used similar to the traditional Lincoln Log® Sets or Lego® sets where only the imagination of the user limits what may be created.

Due to the interconnectivity of the constructible bottle 1, it may be noted that a method of transportation might be developed to allow for shipping without the need for plastic or cardboard packaging material.

Standard soda or beverage bottles are made of PET plastic, Polyethylene terephthalate, a plastic known for its shatter resistant nature and high tensile strength. Used as a replacement for glass, beverage bottle manufacturers demanded a lightweight bottle which could be of sufficient strength to stack similarly to a glass bottle. PET met the demands of manufacturers and became prominent in the bottling market. These bottles have become popular for not only soda and soft drinks, but almost every type of beverage, including ice tea, sports drinks, fruit juices, etc.

The main reason that beverage bottles are able to withstand high pressures and tensions is due to the material property of the plastic called biaxial orientation. As the plastic is formed, the polymer strands orient themselves in a web like pattern, as opposed to a linear one, thereby allowing the material to be stretched to a desired shape during molding without sacrificing strength.

It is preferable that bottle made according to the herein Invention will utilize Polyethylene terephthalate, similar to standard beverage bottles, in order to benefit from this biaxial orientation of the polymers which is present within the material.

The shape of the bottle lends itself to a rigid shape in certain directions, a property which is beneficial to the herein Invention. The bottle's area moment of inertia makes it most rigid in the widest direction of the bottle, without the side recesses, and least rigid in the direction of the side recesses. When two bottles are connected perpendicularly, this high strength orientation of the bottle fills the recess, thereby adding strength to the vertically oriented bottle and providing increased strength. In axial strength, the bottle functions similarly to an I-beam. It resists bending and buckling due to its I-beam like shape, but is subject to torsional loads easily. The radii on the corners of the recesses and all bottle surfaces reduce stress concentrations and increase the compression strength of the bottle shape.

It is due to these design considerations that it is believed that the bottle of this invention will be of sufficient strength to meet the demands for use in structure creation. In fact, modern beverage bottles are currently used in construction, both filled and empty.

The invention is described in detail with reference to a particular embodiment, but it should be understood that various other modifications can be effected and still be within the spirit and scope of the invention.

We claim:

1. A connectable bottle comprising:

a substantially convex top having a centrally disposed protruding neck extending from said convex top, said neck for mate-able insertion into a second connectable bottle of a similar structure;

a concave bottom having a mating recess for receiving a neck of said second connectable bottle; and a side wall connecting said top and said bottom said side wall containing at least two substantially flat recesses with side gaps which are mirror images of each other each for receiving a similar recess in a side wall of said second connectable bottle, wherein each of said flat recesses is dimensioned to correspond to a recess in the side of said second connectable bottle when axially and longitudinally rotated such that said recess of said bottle and said second bottle are perpendicular to one another.

2. The connectable bottle of claim 1, wherein said necks of said bottle and said second bottle are threaded.

3. The connectable bottle of claim 2, further comprising a threaded cap.

4. The connectable bottle of claim 1, wherein said flat recesses have a depth such that a third connectable bottle may be connected on the opposite side of said second connectable bottle without interfering with said first connectable bottle.

5. The connectable bottle of claim 1, wherein said side wall comprises at least four substantially flat sides.

6. The system according to claim 1, wherein said concave bottom has a plurality of male snap protrusions within said mating recess.

7. A system of inter-connectable bottles, said system comprising:

a plurality of connectable bottles, each said connectable bottle further comprising:

a substantially convex top having a centrally disposed protruding neck extending from said convex top, said neck for mate-able insertion into a second connectable bottle of a similar structure;

a substantially concave bottom having a mating recess for receiving a neck of said second connectable bottle; and a side wall connecting said top and said bottom said side wall containing at least two substantially flat recesses with side gaps which are mirror images of each other each for receiving a similar recess in a side wall of said second connectable bottle, wherein each of said flat recesses is dimensioned to correspond to a recess in the side of said second connectable bottle when axially and longitudinally rotated such that said bottles are perpendicular to one another.

8. The system of claim 7, wherein said side wall comprises at least four substantially flat sides.

9. The connectable bottle of claim 7, wherein said necks of said bottle and said second bottle are threaded.

10. The system of claim 9, wherein said flat recesses have a depth such that a third connectable bottle may be connected on the opposite side of said second connectable bottle without interfering with said first connectable bottle.

11. The system of claim 9, wherein each connectable bottle further comprises a threaded cap.

12. The system according to claim 7, wherein said substantially concave bottom has a plurality of male snap protrusions within said mating recess.

13. A system of interconnecting bottles each said bottle having a storage compartment and a cap for closure of said storage compartment, said system comprising:

a plurality of connectable bottles, wherein each of said bottles comprises a substantially convex top having a centrally disposed protruding neck extending from said convex top, with a lip around said neck for mate-able insertion into a second connectable bottle of a similar structure; a substantially concave bottom being an approximate negative image of said top having a mating recess for receiving of a neck of said second connectable bottle; and a side wall connecting said top and said bottom said side wall containing at least two substantially flat recesses with side gaps which are mirror images of each other each for receiving a similar recess in a side wall of said second connectable bottle, wherein each of said flat recesses is dimensioned to correspond to a recess in the side of said second connectable bottle when axially and longitudinally rotated such that said recess of said bottle and said second bottle are perpendicular to one another and sunken enough to allow a third connectable bottle to be connected on the opposite side of the second connectable bottle without interfering with the first connectable bottle; and wherein said side wall comprises at least four substantially flat sides which prevent rolling when stacking and allow for minimal gap between bottles when connected.

14. The system according to claim 13 wherein said cap is threaded.

15. The system according to claim 13 wherein the plurality of connectable bottles forms a bench.

16. The system according to claim 13 wherein the plurality of connectable bottles forms an enclosure.

17. The system according to claim 13, wherein said necks of said bottle and said second bottle are threaded.

18. The system according to claim 13, wherein said flat recesses are sunken to a depth such that said third connectable bottle may be connected on the opposite side of said second connectable bottle without interfering with said first connectable bottle.

19. The system according to claim 13, wherein said substantially concave bottom has a plurality of male snap protrusions within said mating recess.

* * * * *